United States Patent [19]

Hirai et al.

[11] Patent Number: 4,764,458

[45] Date of Patent: Aug. 16, 1988

[54] HEAT DEVELOPABLE LIGHT-SENSITIVE MATERIAL

[75] Inventors: Hiroyuki Hirai; Hiroshi Hara; Ken Kawata, all of Kanagawa, Japan

[73] Assignee: Fuji Photo Film Co., Ltd., Kanagawa, Japan

[21] Appl. No.: 848,364

[22] Filed: Apr. 4, 1986

[30] Foreign Application Priority Data

Apr. 5, 1985 [JP] Japan ..... 60-72187

[51] Int. Cl.[4] ..... G03C 1/02

[52] U.S. Cl. ..... 430/620; 430/964; 430/203; 430/353

[58] Field of Search ..... 430/620, 964, 203, 353, 430/619

[56] References Cited

U.S. PATENT DOCUMENTS 4,603,103 7/1986 Hirai et al. ..... 430/617

FOREIGN PATENT DOCUMENTS 0143424 11/1984 European Pat. Off. .

OTHER PUBLICATIONS

Research Disclosure, Jun. 1978, Disclosure No. 17029, pp. 2–15, entitled "Photothermographic Silver Halide Systems" by J. W. Carpenter et al.

*Primary Examiner*—Won H. Louie

*Attorney, Agent, or Firm*—Sughrue, Mion, Zinn, Macpeak and Seas

[57] ABSTRACT

A heat developable light-sensitive material is disclosed. The material comprises a support having provided thereon at least a light-sensitive silver halide, a reducing agent, a binder and an organic silver salt of the formula:

(I)

wherein $R_1$ represents a hydrogen atom or a substituted or unsubstituted alkyl, cycloalkyl, alkenyl, alkynyl, aralkyl, aryl or heterocyclic group; $R_2$ represents a hydrogen atom or a substituted or unsubstituted alkyl group; $R_3$ represents a halogen atom, a substituted or unsubstituted alkyl, alkoxy, amino, alkylsulfonyl, arylsulfonyl, carbamoyl, sulfamoyl or alkoxycarbonyl group or a cyano group; X represents wherein $R_4$ represents a hydrogen atom or a substituted or unsubstituted alkyl group, $—SO_2—$, wherein $R_5$ represents a substituted or unsubstituted alkyl group, and and l represents 0 or an integer of from 1 to 3; and when l is 2 or 3, the group $R_3$ may be the same or different. The material provides an image of high density with less fog in a short time even using a reduced amount of a base precursor.

13 Claims, No Drawings

HEAT DEVELOPABLE LIGHT-SENSITIVE MATERIAL

FIELD OF THE INVENTION

This invention relates to a heat developable light-sensitive material containing an organic silver salt. More particularly, it relates to a heat developable light-sensitive material having improved activity and preservability.

BACKGROUND OF THE INVENTION

Heat developable photographic light-sensitive materials and the image formation process thereof are well known in the art and are described, e.g., in *Shashin Kogaku no Kiso* (*Foundamentals of Photographic Engineering*), pages 553–555, Corona (1979), *Shashin Joho* (*Information of Reflection Images*), page 40 (April, 1978), *Neblett's Handbook of Photography and Reprography*, 7th Ed., pages 32–33, Van Nostrand Reinhold Company, etc.

Organic silver salts used in heat developable light-sensitive materials typically include silver salts of aliphatic carboxylic acids or aromatic carboxylic acids. Silver salts of aliphatic carboxylic acids having a thioether group as disclosed in U.S. Pat. No. 3,330,663 are also employed.

However, these conventional carboxylic acid silver salts have a disadvantage in that reaction between these silver salts and a reducing agent results in release of an acid, which reduces the pH of a layer. As a result, the subsequent development may be inhibited.

Organic silver salts, other than the carboxylic acid salts described above, have been employed and include silver salts of compounds having a mercapto group or thione group or derivatives thereof. In addition, Japanese Patent Publication Nos. 30270/69 and 18416/70 disclose silver salts of compounds having an imino group, such as benzotriazole and its derivatives.

These silver salts, however, involve a disadvantage in that reaction with a reducing agent results in a release of a compound that causes development inhibition and, in some cases, fogging. Further, some of these compounds inhibit the activity of spectral sensitizing dyes. This results in failure to obtain high sensitivity.

In order to eliminate these disadvantages, heat decomposable organic silver salts have been proposed in Japanese Patent Application (OPI) No. 211454/85 (the term "OPI" as used herein refers to a "published unexamined Japanese patent application") (corresponding to European Pat. No. 143,424 A2). Although these compounds are excellent in providing images of high density in a short time, they are still unsatisfactory in terms of stability during preservation and need further improvement.

Heat developable light-sensitive materials frequently contain a base or a base precursor for heat development acceleration. In particular, a base precursor capable of releasing a basic material upon heat decomposition has been employed to advantage in view of preservability. In this case, as the content of the base precursor in the light-sensitive material increases, development is accelerated but, in turn, unfavorable side effects, such as increase in fog, inhibition on sensitizing dyes, and the like, are accompanied. Therefore, it is desirable to use such a base precursor in a low concentration as possible.

As a result of the above, it has been desired to develop a highly active organic silver salt that can provide images of high density with a small amount of a base precursor.

SUMMARY OF THE INVENTION

An object of this invention is to provide a heat developable light-sensitive material which can provide images of high density with less fog in a short time in the presence of a small amount of a base precursor without producing any side effect after heat development.

The above object has been met by a heat developable light-sensitive material which comprises a support having provided thereon at least a light-sensitive silver halide, a reducing agent, a binder and an organic silver salt represented by the formula (I):

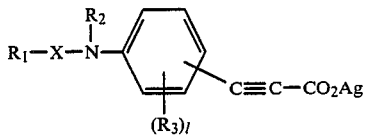

(I)

wherein $R_1$ represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group or a substituted or unsubstituted heterocyclic group; $R_2$ represents a hydrogen atom or a substituted or unsubstituted alkyl group; $R_3$ represents a halogen atom, a substituted or unsubstituted alkyl group, a substituted or unsubstituted alkoxy group, a substituted or unsubstituted amino group, a substituted or unsubstituted alkylsulfonyl group, a substituted or unsubstituted arylsulfonyl group, a substituted or unsubstituted carbamoyl group, a substituted or unsubstituted sulfamoyl group, a substituted or unsubstituted alkoxycarbonyl group or a cyano group; X represents a divalent group selected from

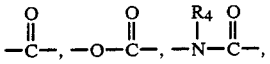

wherein $R_4$ represents a hydrogen atom or a substituted or unsubstituted alkyl group, $—SO_2—$,

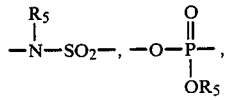

wherein $R_5$ represents a substituted or unsubstituted alkyl group, and

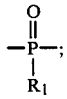

and l represents 0 or an integer of from 1 to 3; when l is 2 or 3, groups represented by $R_3$ may be the same or different.

DETAILED DESCRIPTION OF THE INVENTION

In the above described formula (I), $R_1$ represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group or a substituted or unsubstituted heterocyclic group. Substituents for the groups as represented by $R_1$ except for a hydrogen atom include a halogen atom, an alkyl group, an aryl group, an alkoxy group, a carbamoyl group, an N-arylcarbamoyl group, an alkynyl group, an acylamido group, etc. These substituents may further be substituted with the above enumerated substituents.

Specific examples of the substituents are a chlorine atom, a methyl group, a phenyl group,

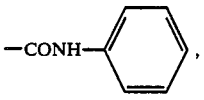

a methoxy group, $-NHCOCH_3$,

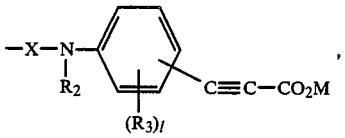

wherein $R_2$, $R_3$, X and l are as defined above, and M represents a monovalent metal atom (e.g., 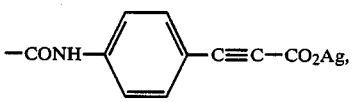

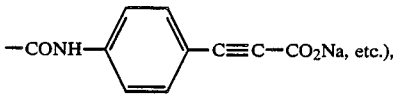

and the like.

Specific preferred examples of $R_1$ include a hydrogen atom; an alkyl group having from 1 to 11 carbon atoms, e.g., a methyl group, an isopropyl group, a t-butyl group, etc.; a substituted or unsubstituted aryl group having from 6 to 10 carbon atoms, e.g., a phenyl group, a p-chlorophenyl group, a p-methoxyphenyl group, etc.; a cycloalkyl group having from 5 to 8 carbon atoms, e.g., a cyclopentyl group, a cyclohexyl group, etc.; an aralkyl group having from 7 to 12 carbon atoms, e.g., a benzyl group, a β-phenethyl group, etc.; a styryl group; a phenylethynyl group; a 2-thienyl group, a 2-furyl group;

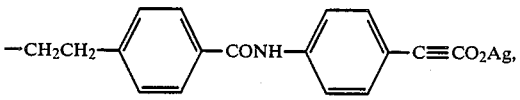

-continued

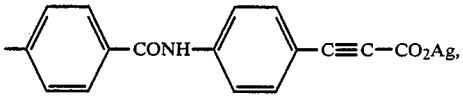

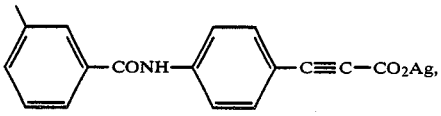

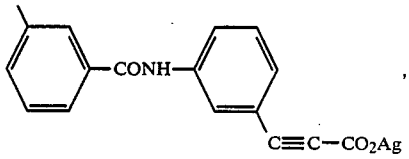

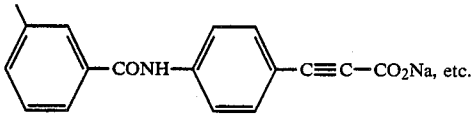

$R_2$ represents a hydrogen atom or a substituted or unsubstituted alkyl group, with a hydrogen atom being preferred.

$R_3$ represents a halogen atom, a substituted or unsubstituted alkyl group, a substituted or unsubstituted alkoxy group, an acylamino group, a sulfonylamino group, an alkylamino group, a dialkylamino group, a substituted or unsubstituted alkylsulfonyl group, a substituted or unsubstituted arylsulfonyl group, a substituted or unsubstituted carbamoyl group, a substituted or unsubstituted sulfamoyl group, a substituted or unsubstituted alkoxycarbonyl group, or a cyano group. Preferred groups for $R_3$ are a methyl group, a methoxy group, a methoxyethoxy group, a halogen atom, an acylamino group having from 1 to 8 carbon atoms, an alkylsulfonylamino group having from 1 to 8 carbon atoms, an arylsulfonylamino group having 6 to 7 carbon atoms, and the like.

X represents a divalent group selected from

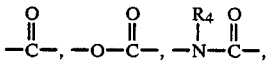

wherein $R_4$ represents a hydrogen atom or a substituted or unsubstituted alkyl group, $-SO_2-$,

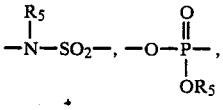

wherein $R_5$ represents a substituted or unsubstituted alkyl group, and

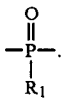

Preferred groups for X are $$-\overset{O}{\overset{\|}{C}}-,\ -O-\overset{O}{\overset{\|}{C}}-,\ -NH-\overset{O}{\overset{\|}{C}}-,$$
$-SO_2-$ and $-NHSO_2-$.
l represents 0 or an integer of from 1 to 3.
When l is 2 or 3, the groups of $R_3$ may be the same or different.
Specific examples of the organic silver salts which can preferably be used in the present invention are shown below:
(1)
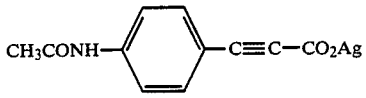
(2)
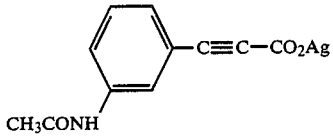
(3)
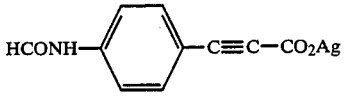
(4)
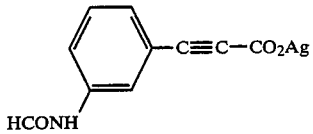
(5)
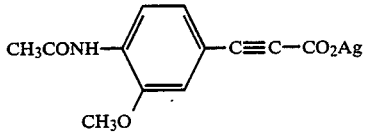
(6)
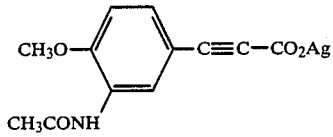
(7)
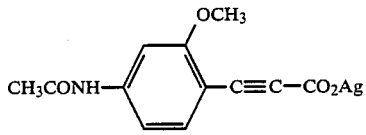
(8)
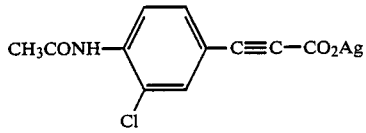
(9)
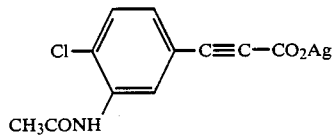
-continued
(10)
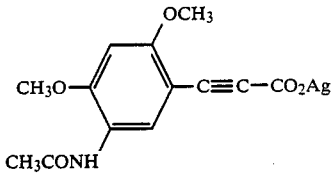
(11)
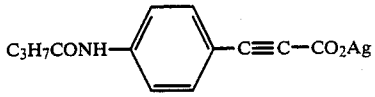
(12)
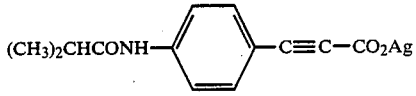
(13)
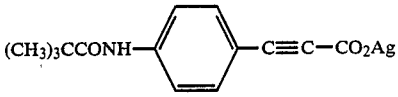
(14)
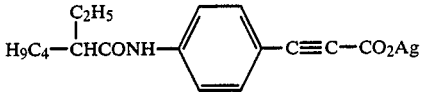
(15)
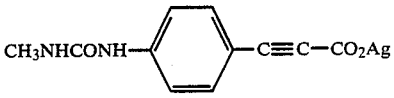
(16)
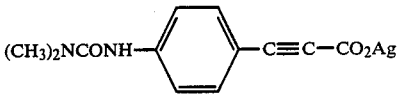
(17)
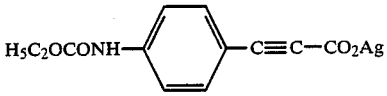
(18)
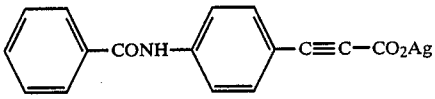
(19)
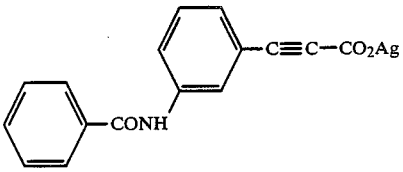
(20)
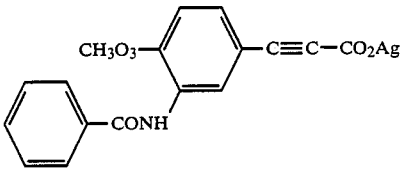
(21)
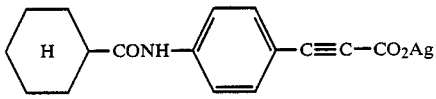

-continued
(22)
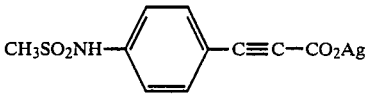
(23)
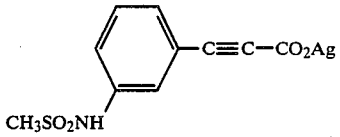
(24)
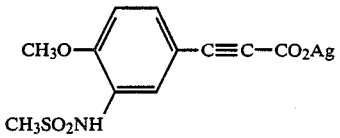
(25)
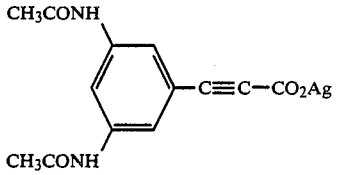
(26)
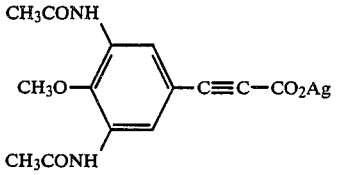
(27)
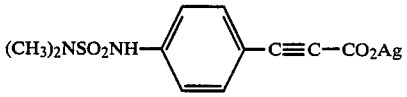
(28)
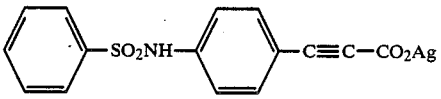
(29)
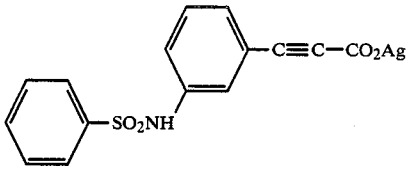
(30)
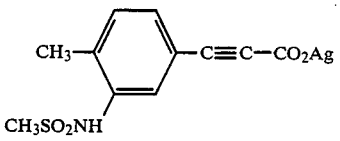
(31)
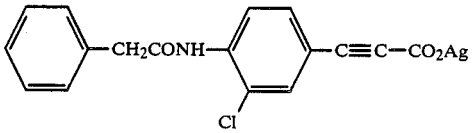
(32)
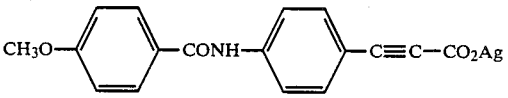
-continued
(33)
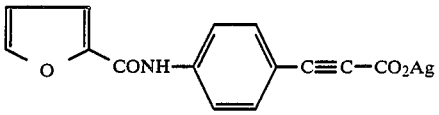
(34)
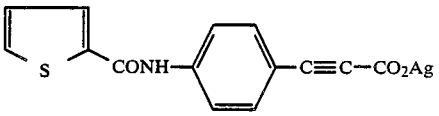
(35)
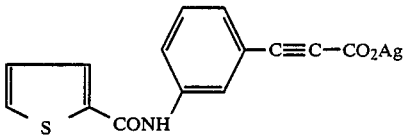
(36)
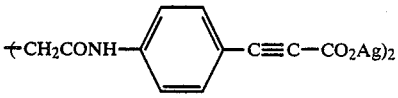
(37)
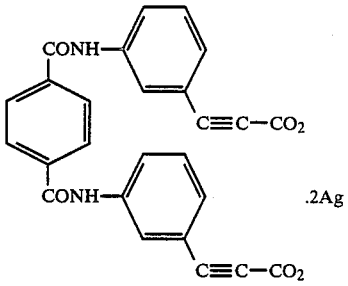
.2Ag
(38)
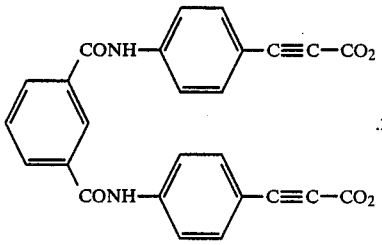
.2Ag
(39)
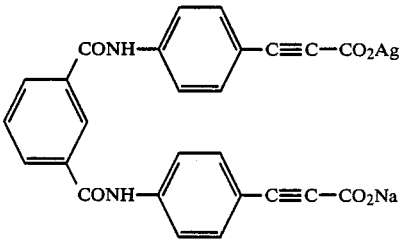
(40)
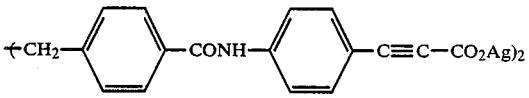
(41)
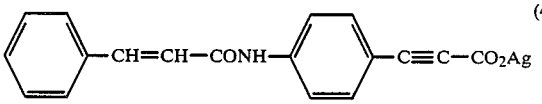

-continued (42)

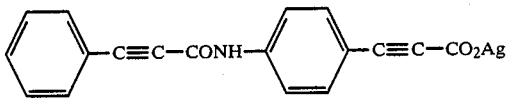

(43)

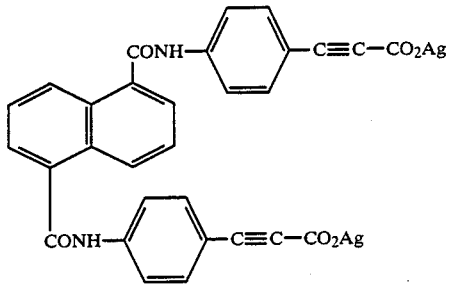

The organic silver salts of the formula (I) according to the present invention can be prepared by synthesizing a carboxylic acid according to the following reaction scheme A or B and mixing the carboxylic acid with a silver ion donator, e.g., silver nitrate.

Scheme A:

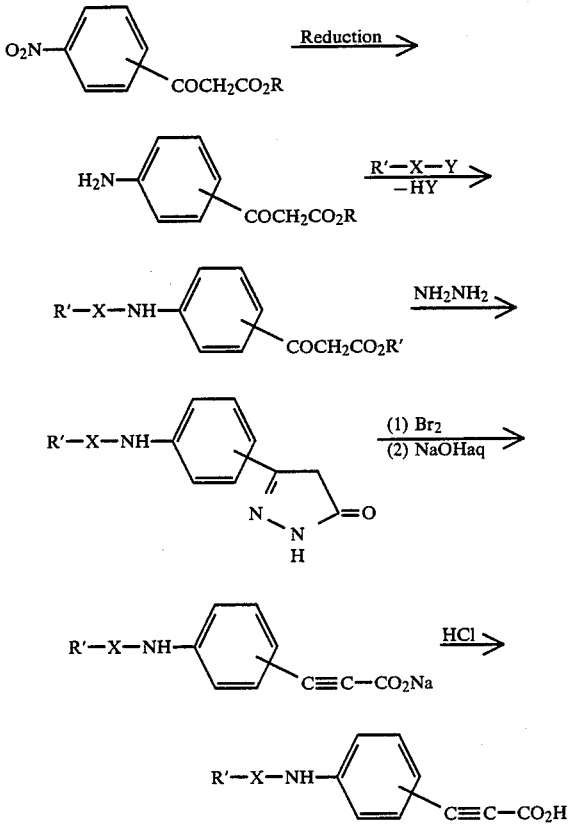

Scheme B:

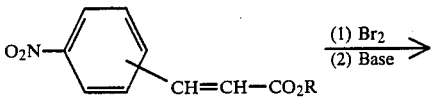

-continued

Scheme A:

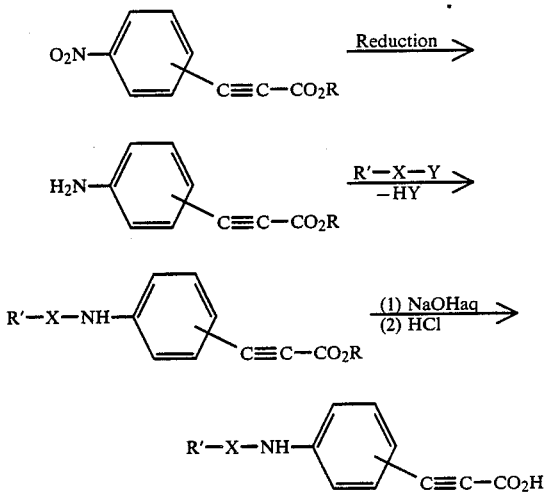

A synthesis example of the organic silver salt of the present invention is given below.

Synthesis of Compound (1):

Into a mixture comprising 224 g of reduced iron, 13.4 g of ammonium chloride, 1 liter of isopropyl alcohol and 0.2 liter of water was added 237 g of ethyl p-nitrobenzoylacetate in small portions at a temperature between 50° C. and 70° C. with caution against heat generation. The mixture was allowed to react at 70° C. for 1 hour, followed by filtration. To the filtrate was added 1 liter of water, and crystals precipitated upon cooling to 5° C. were separated by filtration to obtain 172 g of ethyl p-aminobenzoylacetate as yellow crystals having a melting point of 82° to 84° C.

In 440 ml of acetonitrile was dissolved 146 g of ethyl p-aminobenzoylacetate, and 70 ml of acetic anhydride was added dropwise to the solution at 40° C. After reacting at 40° C. for 1 hour, 48.8 g of 80% hydrazine hydrate was added thereto dropwise. After heat generation subsided, the reaction was further continued at a temperature between 55° C. and 60° C. for 1 hour. The reaction mixture was cooled to 5° C., and the precipitated crystals were filtered to yield 148 g of 3-(4-acetylaminophenyl)-2-pyrazolin-5-one as gray crystals having a melting point of 254° to 258° C.

Into a mixture of 69 g of the above obtained crystals and 330 ml of acetonitrile was dropped 33.4 ml of bromine at a temperature of 15° C. or lower. After stirring for 1 hour, the resulting yellow mixture was added dropwise to 500 ml of an aqueous solution containing 76 g of sodium hydroxide at a temperature of 15° C. or lower, followed by allowing the mixture to stand overnight. Water was added thereto to make 2 liters, and 90 ml of 35% hydrochloric acid was slowly added thereto. The precipitated yellow crystals were filtered and thoroughly washed with water to obtain crude crystals of p-acetylaminophenylpropiolic acid.

The resulting crude crystals were added to a solution of 14 g of sodium hydroxide in 140 ml of water. After stirring at 40° C. for 30 minutes, 45 g of sodium chloride was added thereto, whereby a sodium salt of p-acetylaminopropiolic acid was precipitated. The mixture was cooled to 10° C., and the precipitate was filtered and thoroughly washed with saturated aqueous sodium chloride solution to obtain white crystals. The resulting crystals were added to 400 ml of warm water at 50° C., and any insoluble matter was removed by filtration. To the filtrate was added dropwise 30 ml of 35% hydrochloric acid, and the precipitated white crystals were collected by filtration to give 42.5 g of p-acetylaminophenylpropiolic acid having a melting point of 183° to 185° C. (with decomposition).

The thus prepared acid was converted to a silver salt in a usual manner.

Other organic silver salts could be prepared in the same manner as described above.

The organic silver salts of the present invention may be prepared either in a system combined with preparation of other components of a heat developable light-sensitive material or in an independent system apart from other components of a heat developable light-sensitive material. For considerations of ease of control in the preparation or ease of storage, it is preferable to prepare them separately from the other components of a heat developable light-sensitive material.

The organic silver salts according to the present invention may be used in combination of two or more thereof and, further, in combination with other known organic silver salts. They may be used in a layer containing a light-sensitive silver halide or a layer adjacent thereto.

The organic silver salts of the present invention can be used in a broad range of concentration, i.e., of from 10 mg to 10 g per $m^2$ as converted to silver or of from 0.01 to 200 mols, as converted to silver, per mol of light-sensitive silver halide.

Forms and grain sizes of the organic silver salt of the present invention may arbitrarily be selected, but a preferred mean grain size is 10 μm or smaller.

Organic compounds for forming known organic silver salts that can be used in combination with the organic silver salts according to the present invention include aliphatic or aromatic carboxylic acids, thiocarbonyl group-containing compounds having a mercapto group or an α-hydrogen atom, imino group-containing compounds, and so on.

Typical examples of silver salts of the aliphatic carboxylic acids are silver salts of behenic acid, stearic acid, oleic acid, lauric acid, capric acid, myristic acid, palmitic acid, maleic acid, fumaric acid, tartaric acid, furilic acid, linolic acid, linoleic acid, adipic acid, sebacic acid, succinic acid, acetic acid, butyric acid or camphoric acid. Silver salts of these aliphatic carboxylic acids substituted with a halogen atom or a hydroxyl group and silver salts of aliphatic carboxylic acids having a thioether group may also be used.

Typical examples of silver salts of the aromatic carboxylic acids and silver salts of other carboxyl group-containing compounds are silver salts of benzoic acid, 3,5-dihydroxybenzoic acid, o-, m- or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid or 3-carboxymethyl-4-methyl-4-thiazoline-2-thione, etc.

Examples of silver salts of the compounds having a mercapto group or a thiocarbonyl group include silver salts of 3-mercapto-4-phenyl-1,2,4-triazole, 2-mercaptobenzimidazole, 2-mercapto-5-aminothiadiazole, 2-mercaptobenzothiazole, S-alkylthioglycolic acids having from 12 to 22 carbon atoms in the alkyl moiety, dithiocarboxylic acids, e.g., dithioacetic acid, thioamides, e.g., thiostearamide, 5-carboxy-1-methyl-2-phenyl-4-thiopyridine, and the mercapto compounds described in U.S. Pat. No. 4,123,274, e.g., mercaptotriazine, 2-mercaptobenzoxazole, ·mercaptoxadiazole or 3-amino-5-benzylthio-1,2,4-triazole, etc.

Typical examples of silver salts of the compounds having an imino group are silver salts of benzotriazole or derivatives thereof as disclosed in Japanese Patent Publication Nos. 30270/69 and 18416/70, e.g., benzotriazole, alkyl-substituted benzotriazoles (e.g., methylbenzotriazole, etc.), halogen-substituted benzotriazoles (e.g., 5-chlorobenzotriazole, etc.) and carboimidobenzotriazoles (e.g., butylcarboimidobenzotriazole, etc.); nitrobenzotriazoles as disclosed in Japanese Patent Application (OPI) No. 118639/83; sulfobenzotriazole, carboxybenzotriazole or its salts or hydroxybenzotriazole as disclosed in Japanese Patent Application (OPI) No. 118638/83; 1,2,4-triazole or 1H-tetrazole disclosed in U.S. Pat. No. 4,220,709; carbazole, saccharin, imidazole and its derivatives, etc.

In addition, the silver salts described in *Research Disclosure,* Vol. 170, No. 17029 (June, 1978) and the silver salts of heat decomposable carboxylic acids, e.g., phenylpropiolic acid, as described in Japanese Patent Application (OPI) No. 113235/85 (corresponding to European Pat. No. 143,424 A2) may also be used in the present invention.

In the present invention, silver halides are used as light-sensitive materials. Silver halides to be used include silver chloride, silver chlorobromide, silver chloroiodide, silver bromide, silver iodobromide, silver chloroiodobromide and silver iodide. These silver halides can be obtained, for example, by adding a silver nitrate solution to a potassium bromide solution to form silver bromide grains and then adding potassium iodide thereto.

Two or more silver halides having different sizes and/or silver halide compositions may be used in combination.

The silver halide grains to be used in the present invention preferably have a mean grain size of from 0.001 to 10 μm, and more preferably from 0.001 to 5 μm.

The silver halides can be used as such, but may be subjected to chemical sensitization with chemical sensitizing agents, such as compounds of sulfur, selenium, tellurium, etc., and compounds of gold, platinum, palladium, rhodium, iridium, etc.; reducing agents, such as tin halides, etc.; or combinations thereof. Details for chemical sensitization are described in T. H. James, *The Theory of the Photographic Process,* 4th Ed., Chapter 5, pages 149–169.

The light-sensitive silver halide is suitably coated to a silver coverage of from 1 mg to 10 g per $m^2$.

The silver halide to be used in the present invention may be spectrally sensitized with methine dyes or others. Details for spectral sensitization are described in Japanese Patent Application No. 199891/84, pages 19–22.

In the present invention, silver may be used as an image forming material, or various image forming materials can be used in various processes.

Examples of dye providing substances which can be used in the present invention include couplers capable of reacting with a developing agent. These couplers are capable of reacting with an oxidation product of a developing agent which results from an oxidation reduction reaction between a silver salt and a developing agent to thereby form a dye. This dye formation system is described in a number of publications. For example, specific examples of developing agents and couplers are described, e.g., in T. H. James, *The Theory of the Photographic Process*, 4th Ed., pages 291–334 and pages 354–361, Shinichi Kikuchi, *Shashin Kagaku* (*Photographic Chemistry*), 4th Ed., pages 284–295, Kyoritsu Shuppan, etc.

Dye providing substances to be used in the present invention further include dye-silver compounds in which an organic silver and a dye are bonded. Specific examples of the dye-silver compounds are described in *Research Disclosure* (RD-16966), pages 54–58 (May, 1978), etc.

Azo dyes which are used in heat development type silver dye bleach process can also be used as dye providing substances. Specific examples of the azo dyes and the process of bleach are described, e.g., in U.S. Pat. No. 4,235,957, *Research Disclosure* (RD-14433), pages 30–32 (April, 1976), etc.

Leuco dyes described in U.S. Pat. Nos. 3,985,565 and 4,022,617, etc., can also be used as dye providing substances.

Further, dye providing substances to be employed includes compounds capable of imagewise releasing or diffusing a diffusible dye which are useful in the system described, e.g., in European Pat. Nos. 76,492 and 79,056.

This type of compound can be represented by the formula (LI):

$$(\text{Dye-X})_n\text{—Y} \qquad \text{(LI)}$$

wherein Dye represents a dye group or a dye precursor group; X represents a simple bond or a linking group; Y represents a group which makes a difference in diffusibility of $(\text{Dye-X})_n$—Y or which releases Dye to make a difference in diffusibility between released Dye and $(\text{Dye-X})_n$—Y in correspondence or countercorrespondence to a light-sensitive silver salt having an imagewise latent image; and n represents 1 or 2; when n is 2, two Dye-X moieties may be the same or different.

Specific examples of the dye providing substances represented by the formula (LI) include dye developing agents comprising a hydroquinone type developing agent moiety and a dye moiety as described in U.S. Pat. Nos. 3,134,764, 3,362,819, 3,597,200, 3,544,545 and 3,482,972, etc. Further, substances which release a diffusible dye through intramolecular nucleophilic substitution reaction are disclosed in Japanese Patent Application (OPI) No. 63618/76, and substances which release a diffusible dye through intramolecular rearrangement reaction of an isoxazolone ring are disclosed in Japanese Patent Application (OPI) No. 111628/74. In any of the systems in which the above described compounds are employed, a diffusible dye is released or diffused in areas wherein development has not taken place and a dye is neither released nor diffused in areas wherein development has taken place.

In these systems, since development and release of dyes proceed in parallel, it is very difficult to obtain images having high S/N ratios. In order to eliminate this disadvantage, there has been proposed a system in which a dye providing substance in an oxidized state incapable of releasing a dye is present together with a reducing agent or a precursor thereof and, after development, the dye providing substance in an oxidized state is reduced by the reducing agent remaining unoxidized to thereby release a diffusible dye. Specific examples of the dye providing substances used in this system are described in Japanese Patent Application (OPI) Nos. 110827/78, 130927/79, 164342/81 and 35533/78.

On the other hand, a system, in which a coupler having a diffusible dye moiety as an eliminating group is reacted with an oxidation product of a developing agent to release a diffusible dye in areas where development has taken place, is described in British Pat. No. 1,330,524, Japanese Patent Publication No. 39165/73 and U.S. Pat. No. 3,443,940, etc. Further, a system, in which a coupler having an antidiffusible group as an eliminating group is reacted with an oxidation product of a developing agent to form a diffusible dye, is described in U.S. Pat. No. 3,227,550, etc.

The above described systems using color developing agents involve a serious problem of image stain due to oxidative decomposition products of a developing agent. For the purpose of overcoming this problem, a dye providing substance having per se a reducing property and requiring no developing agent has been proposed. Typical examples of such a dye providing substance are shown below together with the reference publication. Symbols used in the following formulae are defined in the respective publications:

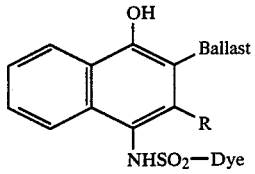

U.S. Pat. No. 3,928,312

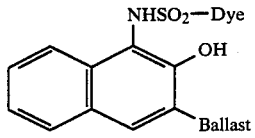

U.S. Pat. No. 4,053,312

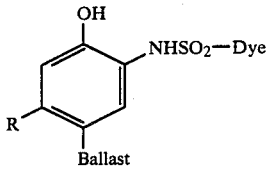

U.S. Pat. No. 4,055,428

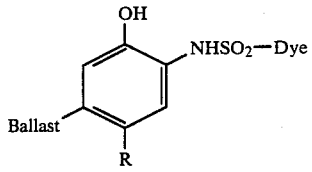

U.S. Pat. No. 4,336,322

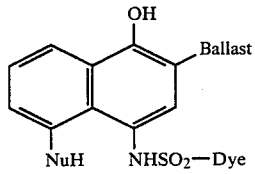

Japanese Patent Application (OPI) No. 65839/84

-continued

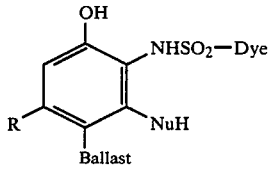

Japanese Patent Application (OPI) No. 69839/84

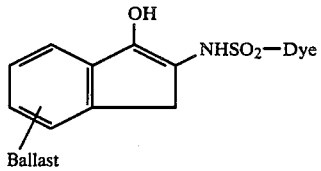

Japanese Patent Application (OPI) No. 3819/78

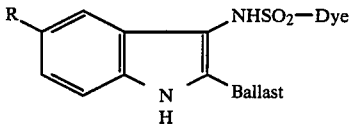

Japanese Patent Application (OPI) No. 104343/76

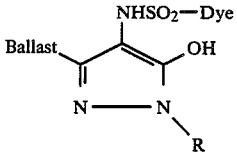

Japanese Patent Application (OPI) No. 104343/76

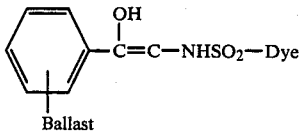

Japanese Patent Application (OPI) No. 104343/76

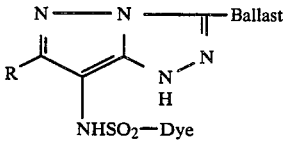

Research Disclosure, No. 17465

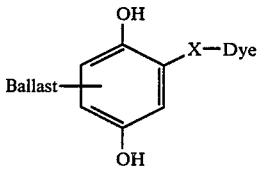

U.S. Pat. No. 3,725,062

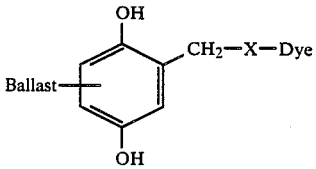

U.S. Pat. No. 3,728,113

-continued

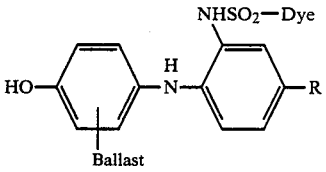

U.S. Pat. No. 3,443,939

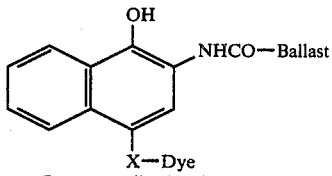

Japanese Patent Application (OPI) No. 116537/83

Any of the above recited various dye providing substances can be used in the present invention.

In the present invention, it is preferable to use, as an image forming substance, a dye providing substance which is reductive to exposed light-sensitive silver halide and is capable of reacting with the silver halide upon heating to thereby release a diffusible dye. Inter alia, dye providing substances represented by the formula (CI) are more preferred:

$$IR\text{-}SO_2\text{—}D \qquad (CI)$$

wherein IR represents a reducing substrate which is cleaved in correspondence or countercorrespondence to a light-sensitive silver halide having an imagewise latent image to release a dye and which makes a difference in mobility between the released dye and a dye providing substance; D represents a mobile image forming dye moiety or its precursor which may contain a linking group to $SO_2$.

The reducing substrate (IR) in the dye providing substance $IR\text{-}SO_2\text{—}D$ preferably has an oxidation reduction potential of 1.2 V or less relative to a saturated calomel electrode in a polargraphic half wave potential determination using acetonitrile as a solvent and sodium perchloric acid as a supporting electrolyte.

Specific examples of the reducing substrate as represented by IR include various groups described in European Pat. No. 76,492, pages 19–24. Among them, groups represented by the following formula (CII) are preferred.

(CII)

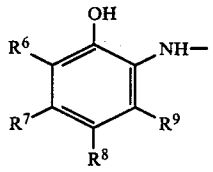

wherein $R^6$, $R^7$, $R^8$ and $R^9$ each represents a hydrogen atom, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted aralkyl group, an acyl group, an acylamino group, a substituted or unsubstituted alkylsulfonylamino group, a substituted or unsubstituted arylsulfonylamino group, a substituted or unsubstituted aryloxyalkyl group, a substituted or unsubstituted alkoxyalkyl group, an N-substituted carbamoyl group, an N-substituted sulfamoyl group, a halogen atom, a substituted or unsubstituted alkylthio group or a substituted or unsubstituted arylthio group.

The substituents for the alkyl or aryl moiety of $R^6$, $R^7$, $R^8$ and $R^9$ may include an alkoxy group, a halogen atom, a hydroxyl group, a cyano group, an acyl group, an acylamino group, a substituted carbamoyl group, a substituted sulfamoyl group, an alkylsulfonylamino group, an arylsulfonylamino group, a substituted ureido group and a carboalkoxy group.

The hydroxyl group and/or amino group in IR represented by the formula (CII) may be protected with a protective group that can be removed by nucleophilic reagents.

In a more preferred embodiment of the present invention, the reducing substrate IR can be represented by the formula (CIII):

(CIII)

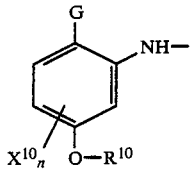

wherein G represents a hydroxyl group or a group capable of providing a hydroxyl group upon hydrolysis; $R^{10}$ represents an alkyl group or an aromatic group; n represents an integer of from 1 to 3; and $X^{10}$ represents a halogen atom or an electron donative group with the proviso that at least one of $X^{10}$ is an electron donative group, or $X^{10}$ may form a condensed ring by itself or together with $-OR^{10}$; and a total number of carbon atoms of $R^{10}$ and $X^{10}$ is at least 8.

Of the groups represented by the formula (CIII), the most preferred are those represented by the formula (CIIIa) or (CIIIb):

(CIIIa)

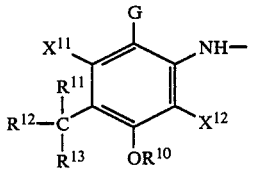

wherein G and $R^{10}$ are as defined above; $R^{11}$ and $R^{12}$, which may be the same or different, each represents an alkyl group, or $R^{11}$ and $R^{12}$ may be connected to jointly form a ring; $R^{13}$ represents a hydrogen atom or an alkyl group; and $X^{11}$ and $X^{12}$, which may be the same or different, each represents a hydrogen atom, an alkyl group, an alkyloxy group, a halogen atom, an acylamino group or an alkylthio group; and $R^{10}$ and $X^{12}$, or $R^{10}$ and $R^{13}$ may be connected to jointly form a ring.

(CIIIb)

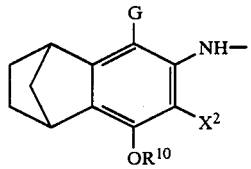

wherein G and $R^{10}$ are as defined above; $X^2$ represents a hydrogen atom, an alkyl group, an alkyloxy group, a halogen atom, an acylamino group or an alkylthio group; and $X^2$ and $R^{10}$ may be connected to jointly form a ring.

Specific examples of the group represented by the formulae (CIII), (CIIIa) and (CIIIb) are described in U.S. Pat. No. 4,055,428 and Japanese Patent Application (OPI) Nos. 12642/81 and 16130/81.

A still further preferred reducing substrate IR can be represented by the formula (CIV):

(CIV)

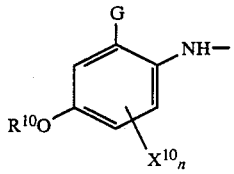

wherein G, $X^{10}$, $R^{10}$ and n are as defined above.

Of the groups represented by the formula (CIV), the more preferred are those represented by the formula (CIVa), (CIVb) or (CIVc):

(CIVa)

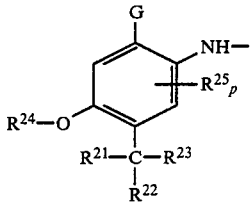

wherein G is as defined above; $R^{21}$ and $R^{22}$, which may be the same or different, each represents an alkyl group or an aromatic group, or they may be bonded to jointly form a ring; $R^{23}$ represents a hydrogen atom, an alkyl group or an aromatic group; $R^{24}$ represents an alkyl group or an aromatic group; $R^{25}$ represents an alkyl group, an alkoxy group, an alkylthio group, an arylthio group, a halogen atom or an acylamino group; p represents 0, 1 or 2; $R^{24}$ and $R^{25}$, $R^{21}$ and $R^{24}$, or $R^{21}$ and $R^{25}$ may be bonded together to form a condensed ring; and a total number of carbon atoms of $R^{21}$, $R^{22}$, $R^{23}$, $R^{24}$ and $R^{25}$ is at least 7.

(CIVb)

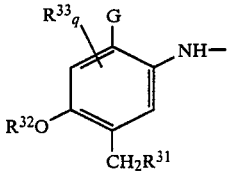

wherein G is as defined above; $R^{31}$ represents an alkyl group or an aromatic group; $R^{32}$ represents an alkyl group or an aromatic group; $R^{33}$ represents an alkyl group, an alkoxy group, an alkylthio group, an arylthio group, a halogen atom or an acylamino group; q represents 0, 1 or 2; $R^{32}$ and $R^{33}$, $R^{31}$ and $R^{32}$, or $R^{31}$ and $R^{33}$ may be bonded to form a condensed ring; and a total number of carbon atoms of $R^{31}$, $R^{32}$ and $R^{33}{}_q$ is at least 7.

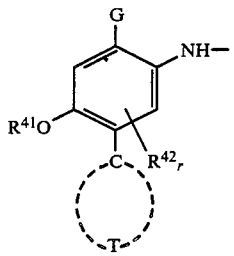

(CIVc)

wherein G is as defined above; $R^{41}$ represents an alkyl group or an aromatic group; $R^{42}$ represents an alkyl group, an alkoxy group, an alkylthio group, an arylthio group, a halogen atom or an acylamino group; r represents 0, 1 or 2;

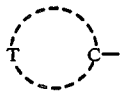

represents a condensed ring composed of 2 to 4 saturated hydrocarbon rings, wherein the carbon atom

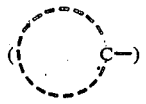

which participates in bonding to the phenol (or its precursor) nucleus is a tertiary carbon atom constituting one member of the condensed ring and a part of the carbon atoms in the hydrocarbon rings except the tertiary carbon atom may be substituted with a oxygen atom or the hydrocarbon rings may have bonded thereto a substituent or may further have condensed thereto an aromatic ring; $R^{41}$ and $R^{42}$ may be taken together with

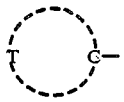

to form a ring; and a total number of carbon atoms of $R^{41}$, $R^{42}{}_r$ and

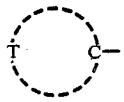

is at least 8.

In the above described formula (CI), the dye moiety represented by D is derived from azo dyes, azomethine dyes, anthraquinone dyes, naphthoquinone dyes, styryl dyes, nitro dyes, quinoline dyes, carbonyl dyes, phthalocyanine dyes, and the like. This dye moiety may be temporarily shifted to a shorter wavelength side. Specific examples of the dye moieties released from the dye providing substances include those described in European Pat. No. 76,492, pages 24–42.

These dye providing substances may be used in combinations of two or more thereof. Such combinations include a combination of two or more dye providing substances which produce the same color and a combination of two or more dye providing substances which form different colors to jointly produce a black color. Examples of the combined use of the dye providing substances are described in Japanese Patent Application No. 199891/84, pages 39–53.

The above described dye providing substances are generally used in an amount of from 0.01 to 4 mols per mol of silver salts.

The above mentioned materials are to be used for forming an imagewise distribution of diffusible dyes in a light-sensitive material in correspondence to exposure by heat development. Methods for transferring these image dyes to a dye fixing material by so-called diffusion transfer to visualize the image are described in the above cited patent publications and Japanese Patent Application (OPI) Nos. 168439/84 and 182447/84, etc.

Introduction of the dye providing substances to layers of a light-sensitive material can be carried out by known processes as described, e.g., in U.S. Pat. No. 2,322,027. More specifically, the dye providing substances can be dissolved in high boiling point organic solvents, such as alkyl phthalates, e.g., dibutyl phthalate, dioctyl phthalate, etc., phosphates, e.g., diphenyl phosphate, triphenyl phosphate, tricresyl phosphate, dioctylbutyl phosphate, etc., citrates, e.g., tributyl acetylcitrate, etc., benzoates, e.g., octyl benzoate, etc., alkyl amides, e.g., diethyl laurylamide, etc., fatty acid esters, e.g., dibutoxyethyl succinate, dioctyl azelate, etc., trimesates, e.g., tributyl trimesate, etc., and the like; organic solvents having a boiling point of from about 30° C. to 160° C., such as lower alkyl acetate, e.g., ethyl acetate, butyl acetate, etc., ethyl propionate, sec-butyl alcohol, methyl isobutyl ketone, β-ethoxyethyl acetate, methyl cellosolve acetate, cyclohexanone, and the like; or mixed solvents of these high boiling point organic solvents and the low boiling point organic solvents. The resulting dye providing substance solution is then dispersed in a hydrophilic colloid.

A dispersion process using polymers as disclosed in Japanese Patent Publication No. 39853/76 and Japanese Patent Application (OPI) No. 59943/76 can also be used. Further, various surface active agents may be used in dispersing the dye providing substance in a hydrophilic colloid. The surface active agents to be used are selected from those hereinafter enumerated.

The amount of the high boiling point organic solvents to be used in the present invention is not more than 10 g, and preferably not more than 5 g, per gram of the dye providing substances used.

In the present invention, a reducing agent is incorporated in a light-sensitive material. The reducing agent includes those known in the art and, preferably, the above recited reducing dye providing substances. Examples of the reducing agent which can be used in the present invention are hydroquinone compounds, e.g., hydroquinone, 2,5-dichlorohydroquinone, 2-chlorohydroquinone, etc.; aminophenol compounds, e.g., 4-aminophenol, N-methylaminophenol, 3-methyl-4-aminophenol, 3,5-dibromoaminophenol, etc., catechol compounds, e.g., catechol, 4-cyclohexylcatechol, 3-methoxycatechol, 4-(N-octadecylamino)catechol, etc., and phenylenediamine compounds, e.g., N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.

More preferred reducing agents are 3-pyrazolidone compounds, e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone.

Combinations of various developing agents as disclosed in U.S. Pat. No. 3,039,869 may also be used in the present invention.

The amount of the reducing agent to be used in the present invention ranges from 0.01 to 20 mols, and preferably from 0.1 to 10 mols, per mol of silver.

In the present invention, various dye releasing activators can be employed. The dye releasing activators are compounds having basicity to activate development or compounds having nucleophilic properties and include bases and base precursors.

Examples of preferred bases include inorganic bases, such as alkali metal or alkaline earth metal hydroxides, secondary or tertiary phosphates, borates, carbonates, metaborates, ammonium hydroxide, hydroxides of quaternary alkylammoniums, and hydroxides of other metals, and the like; and organic bases, such as quinolates, aliphatic amines, e.g., trialkylamines, hydroxylamines and aliphatic polyamines, aromatic amines, e.g., N-alkyl-substituted aromatic amines, N-hydroxyalkyl-substituted aromatic amines, bis[p-(dialkylamino)-phenyl]methanes, etc., heterocyclic amines, amidines, cyclic amidines, guanidines, cyclic guanidines, and the like. Of these, those having a pKa value of 8 or more are particularly preferred.

The base precursors which can be used in the present invention preferably include those capable of undergoing any reaction upon heating to release a base, such as salts of organic acids decomposable through decarboxylation upon heating and bases, and compounds capable of releasing amines through intramolecular nucleophilic substitution, Lossen rearrangement, Beckmann rearrangement, etc. Examples of preferred base precursors are salts of trichloroacetic acid described in British Pat. No. 998,949, salts of $\alpha$-sulfonylacetic acid described in U.S. Pat. No. 4,060,420, salts of propiolic acid as described in Japanese Patent Application (OPI) No. 180537/84, 2-carboxycarboxamide derivatives described in U.S. Pat. No. 4,088,496, salts of heat decomposable acids and organic bases, alkali metals or alkaline earth metals as the base components described in Japanese Patent Application (OPI) No. 195237/84, hydroxycarbamates utilizing Lossen rearrangement described in Japanese Patent Application No. 43860/83 (corresponding to U.S. Pat. No. 4,511,650), aldoxime carbamates capable of forming nitriles upon heating disclosed in Japanese Patent Application No. 31614/83 (corresponding to U.S. Pat. No. 4,499,180), and the like.

In addition, the base precursors described in British Pat. No. 998,945, U.S. Pat. No. 3,220,846, Japanese Patent Application (OPI) No. 22625/75, British Pat. No. 2,079,480, etc., can be also used in this invention.

Specific examples of base precursors which are particularly useful in the present invention are guanidine trichloroacetate, methylguanidine trichloroacetate, potassium trichloroacetate, guanidine phenylsulfonylacetate, guanidine p-chlorophenylsulfonylacetate, guanidine p-methanesulfonylphenylsulfonylacetate, potassium phenylpropiolate, cesium phenylpropiolate, guanidine phenylpropiolate, guanidine p-chlorophenylpropiolate, guanidine 2,4-dichlorophenylpropiolate, diguanidine p-phenylene-bis-propiolate, tetramethylammonium phenylsulfonylacetate and tetramethylammonium phenylpropiolate.

According to the present invention, a wide variety of development stopping agents can be employed for the purpose of obtaining images of constant quality against variation of processing temperature or time of heat development. Details of the development stopping agents are described in Japanese Patent Application No. 199891/84, pages 63–64.

Binders which can be used in the present invention typically include transparent to semi-transparent hydrophilic binders, for example, natural substances, such as proteins, e.g., gelatin, gelatin derivatives, cellulose derivatives, etc., polysaccharides, e.g., starch, gum arabic, etc.; and synthetic polymeric substances, such as water-soluble polyvinyl compounds, e.g., polyvinyl pyrrolidone, acrylamide polymers, etc. As other synthetic polymeric substances, dispersed vinyl compounds in the form of latexes that are particularly effective to increase dimensional stability of photographic materials may also be used. These binders may be used either alone or in combination of two or more thereof.

The binder is used in an amount of from 5 to 90%, and preferably from 5 to 50%, based on the total weight of the coating.

In the present invention, compounds which function not only to activate development but also stabilize an image can be used. Specific examples of such compounds and references therefor are described in Japanese Patent Application No. 199891/84, pages 65–66.

The light-sensitive materials according to the present invention can contain image toning agents, if desired. Details for the image toning agents are described in Japanese Patent Application No. 199891/84, pages 66–67.

The heat developable light-sensitive materials of the present invention are effective to form either negative images or positive images. The formation of negative images or positive images predominantly depends on selection of specific light-sensitive silver halides. For example, for the formation of direct positive images, an internal image type silver halide emulsion as described in U.S. Pat. Nos. 2,592,250, 3,206,313, 3,367,778 and 3,447,927 or a mixture of a surface image type silver halide emulsion and an internal image type silver halide emulsion as described in U.S. Pat. No. 2,996,382 can be used.

Various means for exposure can be used in the present invention. A latent image is obtained by imagewise exposure to radiation inclusive of visible light. In general, commonly employed light sources, such as sunlight, electronic flash, flash bulb, a tungsten lamp, a mercury lamp, a halogen lamp, e.g., an iodine lamp, a xenon lamp, a laser beams, CRT, a plasma light source, a fluorescent tube, light emitting diode, etc., can be used.

In the present invention, development can be carried out by heating light-sensitive materials. The heating means includes hot plates, irons, hot rollers, heating elements using carbon or titanium white, and the like.

Supports which can be used in the light-sensitive materials or dye fixing materials should withstand use at processing temperatures. Usually employed supports include glass, paper, metals and the like, as well as acetyl cellulose film, cellulose ester film, polyvinyl acetal film, polystyrene film, polycarbonate film, polyethylene terephthalate film and the related films or other resin materials. Paper supports laminated with polymers, e.g., polyethylene, can also be used. For lamination, the polyesters described in U.S. Pat. Nos. 3,634,089 and 3,725,070 are preferably used.

The photographic emulsion layers and other binder layers of the photographic light-sensitive materials and dye fixing materials can contain organic or inorganic hardeners. Specific examples of usable hardeners are described in Japanese Patent Application No. 199891/84, pages 69–70.

When the dye providing substance capable of imagewise releasing a diffusible dye is employed, movement of the dye from a light-sensitive layer to a dye fixing layer can be accelerated by a dye transfer assistant. Details for the dye transfer assistant are described in Japanese Patent Application No. 199891/84, pages 70–71.

Other compounds which can be used in the light-sensitive materials according to the present invention include sulfamide derivatives, cation compounds having a pyridinium group, etc., surface active agents having a polyethylene oxide chain, antihalation and antiirradiation dyes, hardeners, mordants, and the like. Specific examples of these compounds are described in European Pat. Nos. 76,492 and 66,282, West German Pat. No. 3,315,485 and Japanese Patent Application (OPI) No. 154445/84 and Japanese Patent Application No. 26008/83 (corresponding to U.S. Pat. No. 4,503,137).

As to methods of exposure and the like, the methods described in the above cited references can be applied.

According to the present invention, the heat developable light-sensitive materials containing the organic silver salt of the formula (I) can provide an image of high density and with less fog in a short time with a small amount of a base precursor without giving adverse side effects after heat development.

The present invention will now be illustrated in greater detail with reference to the following examples, but it should be understood that these examples are not limiting the present invention. In the examples, all the percents are by weight unless otherwise indicated.

EXAMPLE 1

Preparation of Dispersion of Organic Silver Salt:

In a mixture of 1,000 ml of a 0.1% sodium hydroxide aqueous solution and 200 ml of ethanol were dissolved 20 g of gelatin and 5.9 g of 4-acetylaminophenylpropiolic acid. The resulting solution was stirred while maintaining at 40° C. A solution of 4.5 g of silver nitrate in 200 ml of water was added thereto over 5 minutes. The pH of the resulting dispersion was adjusted to precipitate excessive salts, which were then removed. The dispersion was adjusted to a pH of 6.3 to obtain 300 g of a dispersion of Organic Silver Salt (1).

In the same manner as described above, dispersions of Organic Silver Salts (6), (22) and (34) were prepared.

Preparation of Silver Benzotriazole Emulsion:

In 3,000 ml of water were dissolved 28 g of gelatin and 13.2 g of benzotriazole, and the solution was stirred while maintaining at 40° C. A solution of 17 g of silver nitrate in 100 ml of water was added thereto over 2 minutes. An excess of salts was precipitated by pH adjustment and removed. The dispersion was then adjusted to a pH of 6.3 to obtain 400 g of a silver benzotriazole emulsion.

Preparation of Silver Halide Emulsion:

In 1,000 ml of water were dissolved 20 g of gelatin and 3 g of sodium chloride, and the solution was kept at 75° C. while stirring. To the gelatin aqueous solution under warming and stirring were added simultaneously 600 ml of an aqueous solution containing sodium chloride and potassium bromide and a solution of 0.59 mol of silver nitrate in 600 ml of water at equal flow rates over a period of 40 minutes. There was obtained a monodispersed cubic silver chlorobromide emulsion (bromine content: 80 mol%) having a mean grain size of 0.35 μm. After washing with water followed by removal of salts, 5 mg of sodium thiosulfate and 20 mg of 4-hydroxy-6-methyl-1,3,3a,7-tetraazaindene were added thereto to effect chemical sensitization at 60° C. The yield of the emulsion was 600 g.

Preparation of Gelatin Dispersion of Dye Providing Substance:

5 g of Magenta Dye Providing Substance (A) of the formula:

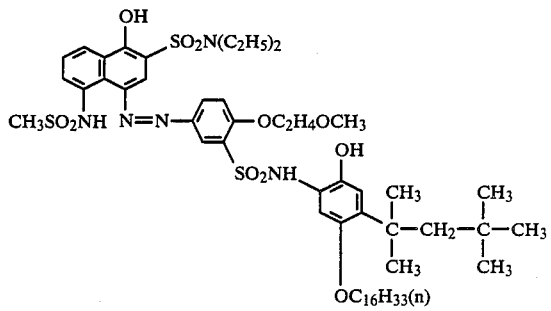

0.5 g of sodium succinate acid-2-ethylhexyl ester sulfonate as a surface active agent and 10 g of triisononyl phosphate were dissolved in 30 ml of ethyl acetate under heating at about 60° C. to form a uniform solution. The solution was mixed with 100 g of a 10% aqueous solution of lime-processed gelatin while stirring, and the mixture was dispersed in a homogenizer at 10,000 rpm for 10 minutes. The resulting dispersion was designated as a magenta dye providing substance dispersion.

Preparation of Light-Sensitive Coating:

| | | |
|---|---|---|
| (a) | Silver benzotriazole emulsion | 10 g |
| (b) | Light-sensitive silver chlorobromide emulsion | 15 g |
| (c) | Dye providing substance dispersion | 25 g |
| (d) | 5% Aqueous solution of a compound of the formula: 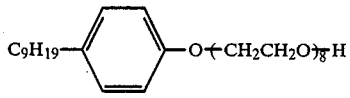  | 5 ml |
| (e) | 10% Methanolic solution of benzenesulfonamide | 5 ml |
| (f) | 7% Solution of guanidine p-chlorophenylsulfonylacetate (50% ethanol aqueous solution) | 15 ml |
| (g) | 0.04% Methanolic solution of a dye of the formula: | 4 ml |

-continued

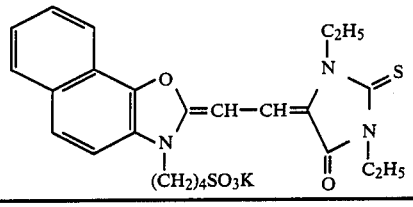

The above components (a) to (g) were mixed and a thickener (poly(styrene-p-sodium sulfonate)) and water were added thereto to make 100 ml. The resulting composition was coated on a 180 μm thick polyethylene terephthalate film to a wet film thickness of 50 μm.

A protective composition was prepared by mixing:

| | |
|---|---|
| (h) 10% Gelatin | 400 g |
| (i) 7% Solution of guanidine p-chlorophenylsulfonylacetate (50% ethanol aqueous solution) | 240 ml |
| (j) Aqueous solution (4%) of a hardener of the formula: | 50 ml |

$CH_2{=}CH{-}SO_2CH_2CONH{-}(CH_2)_2{-}NHCOCH_2SO_2CH{=}CH_2$ and a thickener (poly(styrene-p-sodium sulfonate)) and water were added to the mixture to make 1,000 ml, and the resulting composition was coated on the above described light-sensitive coating to a wet thickness of 30 μm.

The thus produced light-sensitive material was designated as Sample 101.

Sample 102 was prepared in the same manner as for Sample 101 except that the above described dispersion of Organic Silver Salt (1) of the present invention was used in place of the silver benzotriazole emulsion in an amount so as to result in the same silver coverage as obtained by the silver benzotriazole emulsion.

Similarly, Samples 103 to 105 were prepared using the dispersions of Organic Silver Salts (6), (22) and (34), respectively, in place of the silver benzotriazole emulsion.

Each of Samples 101 to 105 was imagewise exposed to light emitted from a tungsten lamp (2,000 lux) through a green filter for 1 second and, thereafter, uniformly heated on a heat block heated at 150° C. for 10 seconds.

Preparation of Dye Fixing Material:

10 g of poly(methyl acrylate-co-N,N,N-trimethyl-N-vinylbenzylammonium chloride) (methyl acrylate:-vinylbenzylammonium chloride=1:1 by mol) were dissolved in 200 ml of water, and the aqueous solution was uniformly mixed with 100 g of a 10% aqueous solution of lime-processed gelatin. The mixture was evenly coated on a paper support laminated with polyethylene having dispersed therein titanium dioxide to a wet film thickness of 90 μm, followed by drying. The resulting sample was used as a dye fixing material having a mordant layer.

After 20 ml/m$^2$ of water was supplied to the coated layer of the dye fixing material, the above prepared light-sensitive material having been heated was brought into contact with the dye fixing material in such a manner that the coating layer of both the materials faced each other. After heating for 6 seconds on a heat block at 80° C., the dye fixing material was stripped from the light-sensitive material. As a result, a magenta dye image on the dye fixing material was obtained. The magenta density was determined by means of a Macbeth reflection densitometer (RD-519), and the results obtained are shown in Table 1 below.

TABLE 1

| Sample No. | Organic Silver Salt | Maximum Density | Minimum Density | Remarks |
|---|---|---|---|---|
| 101 | Silver benzotriazole | 1.23 | 0.10 | Comparison |
| 102 | (1) | 2.12 | 0.13 | Invention |
| 103 | (6) | 2.15 | 0.14 | " |
| 104 | (22) | 2.02 | 0.13 | " |
| 105 | (34) | 2.09 | 0.14 | " |

It can be seen from Table 1 that light-sensitive materials wherein the organic silver salts according to the present invention are used can provide images of high density and low fog.

EXAMPLE 2

Onto a polyethylene terephthalate film were coated the following first (the lowermost) to sixth (the uppermost) layers to produce a multilayer color light-sensitive material (Sample 201).

| | |
|---|---|
| 1st Layer: | |
| Infrared Light-Sensitive Emulsion Layer: | |
| Silver chlorobromide emulsion (bromide content: 50 mol %) | 300 mg-Ag/m$^2$ |
| Benzenesulfonamide | 180 mg/m$^2$ |
| Silver benzotriazole emulsion | 100 mg-Ag/m$^2$ |
| Sensitizing Dye D-3 | $10^6$ mol/m$^2$ |
| Base precursor[1] | 500 mg/m$^2$ |
| Cyan Dye Providing Substance (C) | 300 mg/m$^2$ |
| Gelatin | 1,000 mg/m$^2$ |
| High boiling solvent[2] | 600 mg/m$^2$ |
| Surface active agent[3] | 100 mg/m$^2$ |
| 2nd Layer: | |
| Intermediate Layer: | |
| Gelatin | 1,000 mg/m$^2$ |
| Base precursor[1] | 600 mg/m$^2$ |
| 3rd Layer: | |
| Red-Sensitive Emulsion Layer: | |
| Silver chlorobromide emulsion (bromide content: 80 mol %) | 300 mg-Ag/m$^2$ |
| Benzenesulfonamide | 180 mg/m$^2$ |
| Silver benzotriazole emulsion | 100 mg-Ag/m$^2$ |
| Sensitizing Dye D-2 | $8 \times 10^{-7}$ mol/m$^2$ |
| Base precursor[1] | 450 mg/m$^2$ |
| Magenta Dye Providing Substance (A) | 400 mg/m$^2$ |
| Gelatin | 1,000 mg/m$^2$ |
| High boiling point solvent[4] | 600 mg/m$^2$ |
| Surface active agent[3] | 100 mg/m$^2$ |
| 4th Layer: | |
| Intermediate Layer: | |
| Gelatin | 1,200 mg/m$^2$ |
| Base precursor[1] | 600 mg/m$^2$ |
| 5th Layer: | |
| Green-Sensitive Emulsion Layer: | |
| Silver chlorobromide emulsion (bromine content: 50 mol %) | 400 mg-Ag/m$^2$ |
| Benzenesulfonamide | 180 mg/m$^2$ |
| Silver benzotriazole emulsion | 100 mg-Ag/m$^2$ |
| Sensitizing Dye D-1 | $10^{-6}$ mol/m$^2$ |
| Base precursor[1] | 500 mg/m$^2$ |
| Yellow Dye Providing Substance (B) | 400 mg/m$^2$ |
| Gelatin | 1,000 mg/m$^2$ |
| High boiling point solvent[2] | 800 mg/m$^2$ |
| Surface active agent[3] | 100 mg/m$^2$ |
| 6th Layer: | |
| Protective Layer: | |
| Gelatin | 1,000 mg/m$^2$ |
| Base precursor[1] | 600 mg/m$^2$ |
| Hardener[5] | 100 mg/m$^2$ |

-continued

| Silica[6] | 100 mg/m$^2$ |
|---|---|

Note:
[1]Guanidine 4-acetylaminophenylpropiolate
[2]$(iso\text{-}C_9H_{19}O)_3P{=}O$

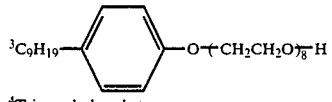

[4]Tricresyl phosphate
[5]1,2-Bis(vinylsulfonylacetamido)ethane
[6]Size: 4 μm

Preparation of Silver Halide Emulsion for First and Fifth Layers:

A gelatin aqueous solution consisting of 20 g of gelatin, 3 g of sodium chloride and 1,000 ml of water was kept at 75° C. under stirring well. To the solution under warming and stirring were added simultaneously 600 ml of an aqueous solution containing sodium chloride and potassium bromide and a solution of 0.59 mol of silver nitrate in 600 ml of water at equal flow rates over a period of 40 minutes to thereby prepare a monodispersed cubic silver chlorobromide emulsion (bromide content: 50 mol%) having a mean grain size of 0.40 μm.

After washing with water and removal of salts, 5 mg of sodium thiosulfate and 20 mg of 4-hydroxy-6-methyl-1,3,3a,7-tetraazaindene to effect chemical sensitization at 60° C. The yield of the emulsion was 600 g.

The silver halide emulsion and silver benzotriazole emulsion used in the third layer were prepared in the same manner as described in Example 1.

Preparation of Gelatin Dispersion of Dye Providing Substance:

5 g of Yellow Dye Providing Substance (B) having the following formula, 0.5 g of sodium succinic acid-2-ethylhexyl ester sulfonate and 10 g of triisononyl phosphate were dissolved in 30 ml of ethyl acetate under heating at about 60° C. to form a uniform solution. The solution was mixed with 100 g of a 10% aqueous solution of lime-processed gelatin while stirring and dispersed in a homogenizer at 10,000 rpm for 10 minutes to prepare a yellow dye providing substance dispersion.

A magenta dye providing substance dispersion was prepared in the same manner as described above but using Magenta Dye Providing Substance (A) as used in Example 1 in place of Yellow Dye Providing Substance (B) and 7.5 g of tricresyl phosphate as a high boiling point solvent.

A cyan dye providing substance dispersion was prepared in the same manner as described for the yellow dye providing substance dispersion but using Cyan Dye Providing Substance (C) having the following formula in place of Yellow Dye Providing Substance (B).

Yellow Dye Providing Substance (B):

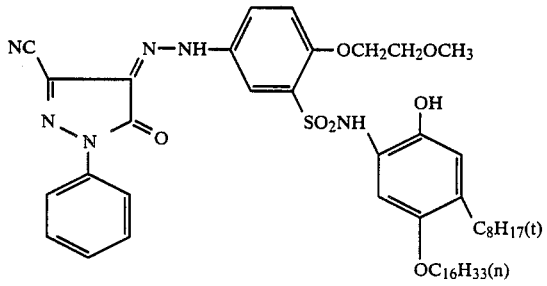

-continued

Cyan Dye Providing Substance (C):

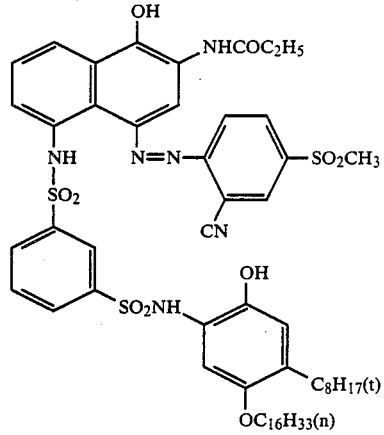

Sensitizing Dye D-1:

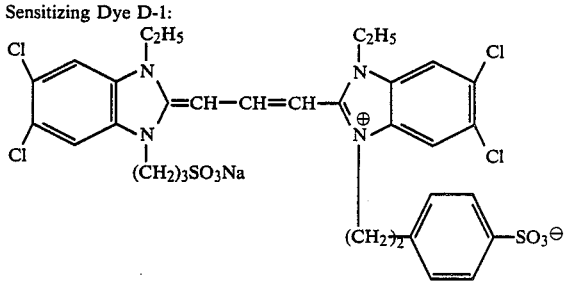

Sensitizing Dye D-2:

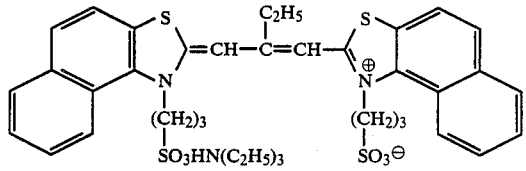

Sensitizing Dye D-3:

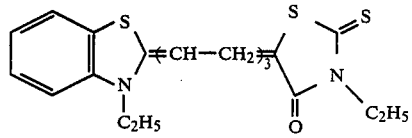

Samples 202 to 205 were prepared in the same manner as for Sample 201 except that the dispersion of Organic Silver Salts (1), (6), (22) and (34) as used in Example 1 were used to a silver coverage of 100 mg/m$^2$, respectively, in place of the silver benzotriazole emulsion in the first, third and fifth layers.

Sample 206 was prepared in the same manner as for Sample 202 but the coverage of the base precursor in the first, third and fifth layers was reduced to one-half.

Each of the thus prepared multilayer color light-sensitive materials (Samples 201 to 206) was exposed to tungsten light (500 lux) through G, R and IR separation filters having continuously varying density (the G filter and R filter were band transmission filters transmitting light of 500 to 600 nm and light of 600 to 700 nm, respectively; and the IR filter transmitted light of more than 700 nm) for 1 second. The exposed sample was heated on a heat block at 150° C. for 5 seconds or 15 seconds.

Water was supplied to the coated surface of the same dye fixing material as used in Example 1 in an amount of 20 ml per $m^2$, and the light-sensitive material was brought into contact with the dye fixing material in such a manner that both the coated surfaces faced each other. After heating on a heat block at 80° C. for 6 seconds, the dye fixing material was stripped from the light-sensitive material. As a result, yellow, magenta and cyan dye images on the dye fixing material were obtained in correspondence to the three color separation filters G, R and IR. The maximum density (Dmax) and minimum density (Dmin) of each color image were determined by the use of a Macbeth reflection densitometer (RD 519). The results obtained are shown in Table 2 below.

TABLE 2

| Sample No. | Organic Silver Salt | Development Time (sec) | Yellow Dmax | Yellow Dmin | Magenta Dmax | Magenta Dmin | Cyan Dmax | Cyan Dmin | Remarks |
|---|---|---|---|---|---|---|---|---|---|
| 201 | Silver | 5 | 0.7 | 0.10 | 0.6 | 0.10 | 0.4 | 0.10 | Comparison |
| | benzotriazole | 15 | 1.8 | 0.11 | 1.7 | 0.11 | 1.7 | 0.12 | " |
| 202 | (1) | 5 | 1.9 | 0.10 | 2.2 | 0.12 | 2.3 | 0.11 | Invention |
| | | 15 | 2.0 | 0.14 | 2.3 | 0.13 | 2.4 | 0.13 | " |
| 203 | (6) | 5 | 1.8 | 0.10 | 2.1 | 0.12 | 2.1 | 0.12 | " |
| | | 15 | 1.9 | 0.13 | 2.2 | 0.13 | 2.3 | 0.13 | " |
| 204 | (22) | 5 | 1.7 | 0.11 | 2.0 | 0.12 | 2.2 | 0.12 | " |
| | | 15 | 1.9 | 0.13 | 2.2 | 0.13 | 2.4 | 0.14 | " |
| 205 | (34) | 5 | 1.8 | 0.10 | 2.1 | 0.13 | 2.3 | 0.13 | " |
| | | 15 | 2.0 | 0.14 | 2.3 | 0.14 | 2.4 | 0.14 | " |
| 206 | (1) | 5 | 0.8 | 0.10 | 1.6 | 0.11 | 1.8 | 0.10 | " |
| | | 15 | 1.9 | 0.12 | 2.1 | 0.12 | 2.2 | 0.12 | " |

It can be seen from Table 2 that the light sensitive materials using the organic silver salts of the present invention can provide sufficient image densities even with a short developing time. Further, even if the amount of a base precursor is reduced to one half, images of sufficient densities can be obtained by development processing for 15 seconds. Thus, the requisite amount of a base precursor can be reduced by the present invention.

EXAMPLE 3

Preparation of Silver Halide Emulsion:

In 3,000 ml of water were dissolved 40 g of gelatin and 26 g of potassium bromide, and the solution was kept at 50° C. under stirring. A solution of 34 g of silver nitrate in 200 ml of water was added to the gelatin aqueous solution over 10 minutes. Thereafter, a solution of 3.3 g of potassium iodide in 1,000 ml of water was added thereto over 2 minutes. An excess of salts were precipitated by pH adjustment and removed. The emulsion was adjusted to a pH of 6.0 to obtain 400 g of a silver iodobromide emulsion.

Preparation of Gelatin Dispersion of Dye Providing Substance:

A mixture of 10 g of Dye Providing Substance (D) of the formula:

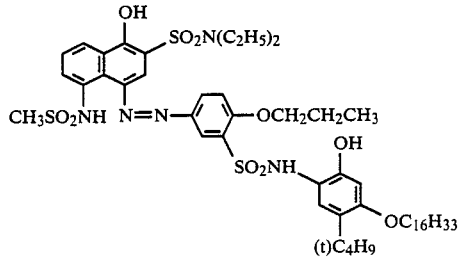

0.5 g of sodium succinic acid-2-ethylhexyl ester sulfonate as a surface active agent and 20 g of tricresyl phosphate was dissolved in 30 ml of ethyl acetate under heating at about 60° C. The resulting solution was mixed with 100 g of a 10% gelatin solution while stirring, and the mixture was dispersed in a homogenizer at 10,000 rpm for 10 minutes. The thus prepared dispersion was designated as dye providing substance dispersion.

Preparation of Light-Sensitive Coating:

| | |
|---|---|
| (a) Light-sensitive silver iodobromide emulsion | 25 g |
| (b) Dye providing substance dispersion | 33 g |
| (c) 5% Aqueous solution of a compound of the formula: 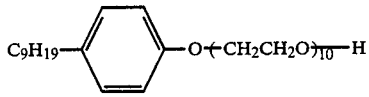 | 10 ml |
| (d) Solution of 1.5 g of guanidine 4-acetylaminophenylpropiolate in 10 ml of ethanol and 15 ml of water | |
| (e) Solution of 0.4 g of $(CH_3)_2NSO_2NH_2$ in 4 ml of methanol | |

The above components (a) to (e) were mixed and dissolved by heating, and the resulting composition was coated on a 180 μm thick polyethylene terephthalate film to a wet thickness of 35 μm, followed by drying.

A protective layer having the following composition was then coated thereon to a wet thickness of 25 μm.

Composition of Protective Layer:

| | |
|---|---|
| (1) 10% Aqueous gelatin solution | 30 g |
| (2) 4% Aqueous solution of a hardener of the formula: $CH_2{=}CHSO_2CH_2CONH{-}CH_2CH_2{-}NHCOCH_2{-}SO_2CH{=}CH_2$ | 8 ml |
| (3) Water | 62 ml |

The resulting light-sensitive material was designated as Sample 301.

Samples 302 to 305 were prepared in the same manner as described for Sample 301 but replacing 10%, based on a silver coverage, of the silver iodobromide emulsion with dispersions of Organic Silver Salts (1), (6), (22) and (34) as used in Example 1, respectively.

Sample 306 was prepared in the same manner as for Sample 301 but increasing the amount of the guanidine 4-acetylaminophenylpropiolate to 2.1 g.

Each of Samples 301 to 306 was imagewise exposed to light emitted from a tungsten lamp (2,000 lux) for 10 seconds and then uniformly heated on a heat block heated at 150° C. for 20 seconds.

The same dye fixing material as used in Example 1 was dipped in water and then brought into contact with the heated sample in such a manner that both the coating surfaces faced each other. After the laminate was heated on a heat block at 80° C. for 6 seconds, the dye fixing material was stripped from the light-sensitive material. As a result, a negative magenta dye image on the dye fixing material was obtained. The maximum and minimum densities of the negative image were determined using a Macbeth reflection densitometer (RD-519), and the results obtained are shown in Table 3.

TABLE 3

| Sample No. | Organic Silver Salt | Maximum Density | Minimum Density | Remarks |
|---|---|---|---|---|
| 301 | — | 1.05 | 0.10 | Comparison |
| 302 | (1) | 2.16 | 0.12 | Invention |
| 303 | (6) | 2.21 | 0.13 | " |
| 304 | (22) | 2.09 | 0.12 | " |
| 305 | (34) | 2.10 | 0.13 | " |
| 306 | — | 2.05 | 0.16 | Comparison |

It is apparent from the results of Table 3 that images of high densities with less fog can be obtained by using a small amount of the organic silver salts according to the present invention. It can further be seen that use of the organic silver salts of this invention greatly reduces the requisite amount of a base precursor.

EXAMPLE 4

Preparation of Silver Benzotriazole Emulsion Containing Light-Sensitive Silver Bromide:

In 1,000 ml of water were dissolved 6.5 g of benzotriazole and 10 g of gelatin. The resulting solution was maintained at 50° C. with stirring. A solution of 8.5 g of silver nitrate in 100 ml of water was then added to the above solution over a period of 2 minutes. A solution of 1.2 g of potassium bromide in 50 ml of water was then added thereto over 2 minutes. An excess of salts were removed by precipitation by pH adjustment, and the emulsion was adjusted to a pH of 6.0 to obtain 200 g of an emulsion.

Preparation of Gelatin Dispersion of Dye Providing Substance:

A mixture of 10 g of Dye Providing Substance (E) of the formula:

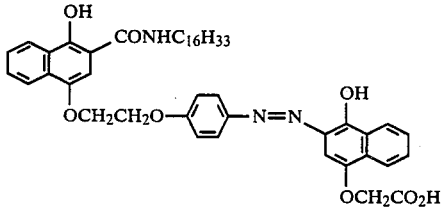

0.5 g of sodium succinic acid-2-ethylhexyl ester sulfonate as a surface active agent and 4 g of tricresyl phosphate was dissolved in 20 ml of cyclohexanone by heating at about 60° C. to form a uniform solution. The resulting solution was mixed with 100 g of a 10% solution of lime-processed gelatin while stirring, and the mixture was dispersed in a homogenizer at 10,000 rpm for 10 minutes.

Preparation of Light-Sensitive Coating:

| | | |
|---|---|---|
| (a) | Silver benzotriazole emulsion containing light-sensitive silver bromide | 10 g |
| (b) | Dye providing substance dispersion | 3.5 g |
| (c) | Base precursor (guanidine 3-acetylamino-4-methoxyphenylpropiolate) | 0.20 g |
| (d) | 10% Aqueous gelatin solution | 5 g |
| (e) | Solution of 0.2 g of 2,6-dichloro-4-aminophenol in 2 ml of methanol | |
| (f) | 10% Aqueous solution of a compound of the formula: | 1 ml |

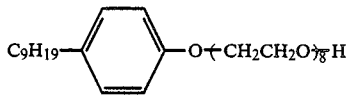

The above components (a) to (f) were mixed and dissolved by heating, and the resulting composition was coated on a 180 μm thick polyethylene terephthalate film to a wet thickness of 30 μm.

A protective layer having the following composition was further coated thereon to a wet thickness of 30 μm, followed by drying.

| | | |
|---|---|---|
| (1) | 10% Gelatin aqueous solution | 30 ml |
| (2) | 4% Aqueous solution of a hardener of the formula: $CH_2{=}CHSO_2CH_2CONHCH_2CH_2NHCOCH_2SO_2CH{=}CH_2$ | 8 ml |
| (3) | Water | 40 ml |
| (4) | Solution of 0.8 g of guanidine 3-acetylamino-4-methoxyphenylpropiolate in 20 ml of water | |

The thus prepared light-sensitive material was designated as Sample 401.

Sample 402 was prepared in the same manner as for Sample 401 but using an emulsion of Organic Silver Salt (1) containing light-sensitive silver bromide as prepared below in place of the silver benzotriazole emulsion containing light-sensitive silver bromide.

Preparation of Emulsion of Organic Silver Salt (1) Containing Light-Sensitive Silver Bromide:

In 300 ml of ethanol and 1,000 ml of a 1% sodium hydroxide aqueous solution were dissolved 11.1 g of 4-acetylaminophenylpropionic acid and 10 g of gelatin, and the resulting solution was maintained at 50° C. while stirring. A solution of 8.5 g of silver nitrate in 100 ml of water was added to the above solution over 2 minutes.

A solution of 1.2 g of potassium bromide in 50 ml of water was then added thereto over a period of 2 minutes. An excess of salts were precipitated by pH adjustment and removed. The emulsion was then adjusted to a pH of 6.0 to obtain 200 g of an emulsion.

Each of Samples 401 and 402 was imagewise exposed to light of a tungsten lamp (2,000 lux) for 10 seconds and then uniformly heated on a heat block heated at 150° C. for 20 seconds.

The same dye fixing material as used in Example 1 was dipped in water and brought into contact with the heated sample in such a manner that both the coated surfaces faced each other. After the laminate was heated on a heat block at 80° C. for 6 seconds, the dye fixing material was stripped off from the light-sensitive material to obtain a negative magenta dye image on the dye fixing material. The densities of the negative image were determined by the use of a Macbeth reflection densitometer (RD-519), and the results obtained are shown in Table 4 below.

TABLE 4

| Sample No. | Maximum Density | Minimum Density | Remarks |
|---|---|---|---|
| 401 | 1.21 | 0.14 | Comparison |
| 402 | 2.14 | 0.17 | Invention |

The results of Table 4 prove that the organic silver salts according to the present invention provide images of high density with less fog.

EXAMPLE 5

Preparation of Gelatin Dispersion of Dye Providing Substance:

A mixture of 5 g of a reducible dye releasing agent of the formula:

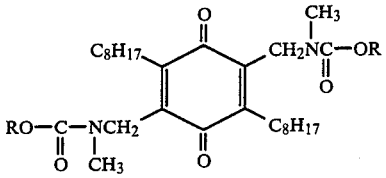

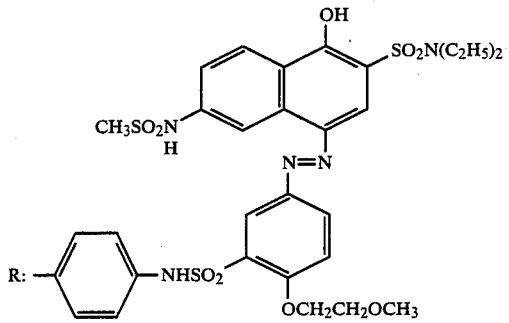

4 g of an electron donor of the formula:

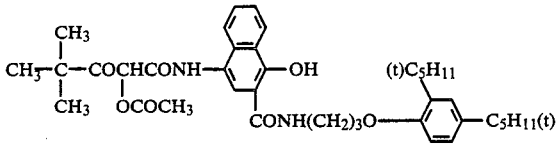

0.5 g of sodium succinic acid-2-ethylhexyl ester sulfonate and 10 g of tricresyl phosphate was dissolved in 20 ml of cyclohexanone under heating at about 60° C. The resulting solution was mixed with 100 g of a 10% gelatin solution with stirring, and the mixture was dispersed in a homogenizer at 10,000 rpm for 10 minutes.

Preparation of Light-Sensitive Coating:

| | | |
|---|---|---|
| (a) | Silver benzotriazole emulsion containing light-sensitive silver bromide (the same as in Example 4) | 10 g |
| (b) | Dye providing substance dispersion | 3.5 g |
| (c) | Base precursor (guanidine 4-methylsulfonylphenylsulfonylacetate) | 0.20 g |
| (d) | 5% Aqueous solution of a compound of the formula: | 1.5 ml |

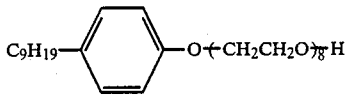

The above components (a) to (d) were mixed and dissolved under heating, and the resulting composition was coated on a polyethylene terephthalate film to a wet thickness of 30 μm, followed by drying.

A protective layer having the following composition was further coated thereon to a wet thickness of 30 μm, followed by drying to prepare a light-sensitive material (Sample 501).

| | | |
|---|---|---|
| (1) | 10% Aqueous gelatin solution | 30 g |
| (2) | Base precursor (guanidine 4-methylsulfonylphenylsulfonylacetate) | 1.0 g |
| (3) | 4% Aqueous solution of a hardener of the formula: $CH_2{=}CHSO_2CH_2CONHCH_2CH_2NHCOCH_2SO_2CH{=}CH_2$ | 8 ml |
| (4) | Water | 62 ml |

Sample 502 was prepared in the same manner as described above for Sample 501 but using the same Organic Silver Salt (1) emulsion containing light-sensitive silver bromide as used in Example 4 in place of the silver benzotriazole emulsion containing light-sensitive silver bromide.

Each of Samples 501 and 502 was imagewise exposed to light using a tungsten lamp (2,000 lux) for 10 seconds, and the exposed sample was heated on a heat block at 140° C. uniformly for 30 seconds.

The heated sample was processed using the same dye fixing material as used in Example 1 in the same manner as in Example 1 to obtain a positive magenta dye image on the dye fixing material. The densities of the positive image were determined by the use of a Macbeth reflection densitometer (RD-519), and the results are shown in Table 5 below.

TABLE 5

| Sample No. | Maximum Density | Minimum Density | Remarks |
|---|---|---|---|
| 501 | 1.62 | 0.20 | Comparison |
| 502 | 2.05 | 0.23 | Invention |

It can be seen from Table 5 that the organic silver salts according to the present invention are effective to provide images of high densities with less fog in a process of forming a positive image as well.

EXAMPLE 6

Preparation of Dye Providing Substance Dispersion:

A dye providing substance dispersion was prepared in the same manner as described in Example 1 but using 5 g of a dye providing substance of the formula:

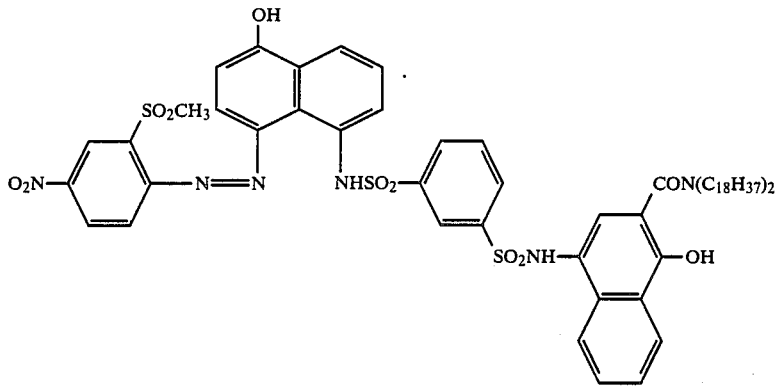

Preparation of Light-Sensitive Coating:

| | | |
|---|---|---|
| (a) | Silver benzotriazole emulsion containing light-sensitive silver bromide (the same as in Example 4) | 10 g |
| (b) | Dye providing substance dispersion | 3.5 g |
| (c) | Solution of 0.28 g of $(CH_3)_2NSO_2NH_2$ in 4 ml of water | |
| (d) | Solution of 0.2 g of 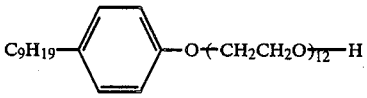 in 4 ml of water | |

The above components (a) to (d) were mixed and dissolved under heating, and the resulting composition was coated on a 180 μm thick polyethylene terephthalate film to a wet thickness of 30 μm. A protective composition having the following formulation was further coated thereon to a wet thickness of 25 μm, followed by drying.

Formulation of Protective Composition:

| | | |
|---|---|---|
| (1) | 10% Aqueous gelatin solution | 30 g |
| (2) | 4% Aqueous solution of a hardener of the formula: $CH_2{=}CHSO_2CH_2CONHCH_2CH_2NHCOCH_2SO_2CH{=}CH_2$ | 8 ml |
| (3) | Water | 62 ml |

The resulting sample was designated as Sample 601.

Sample 602 was prepared in the same manner as described above but using the same emulsion of Organic Silver Salt (1) containing light-sensitive silver bromide as used in Example 4 in place of the silver benzotriazole emulsion containing light-sensitive silver bromide.

Each of Samples 601 and 602 was imagewise exposed to light using a tungsten lamp (2,000 lux) for 10 seconds, and the exposed sample was uniformly heated on a heat block at about 160° C. for 30 seconds.

The heated sample was then processed in the same manner as in Example 1 using the same dye fixing material as used in Example 1. The results obtained are shown in Table 6 below.

TABLE 6

| Sample No. | Maximum Density | Minimum Density | Remarks |
|---|---|---|---|
| 601 | 1.32 | 0.24 | Comparison |
| 602 | 1.85 | 0.24 | Invention |

The results of Table 6 demonstrate that the organic silver salt according to the present invention provides a high density with less fog in an image formation process using no base precursor as well.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having provided thereon at least a light-sensitive silver halide, a reducing agent, a binder and an organic silver salt represented by the formula (I):

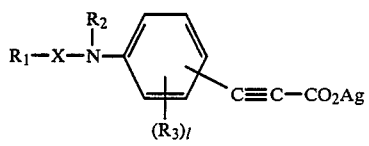

(I)

wherein $R_1$ represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group or a substituted or unsubstituted heterocyclic group; $R_2$ represents a hydrogen atom or a substituted or unsubstituted alkyl group; $R_3$ represents a halogen atom, a substituted or unsubstituted alkyl group, a substituted or unsubstituted alkoxy group, a substituted or unsubstituted amino group, a substituted or unsubstituted alkylsulfonyl group, a substituted or unsubstituted arylsulfonyl group, a substituted or unsubstituted carbamoyl group, a substituted or unsubstituted sulfamoyl group, a substituted or unsubstituted alkoxycarbonyl group or a cyano group; X represents a divalent group selected from

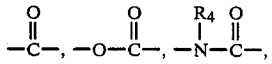

wherein $R_4$ represents a hydrogen atom or a substituted or unsubstituted alkyl group, $—SO_2—$,

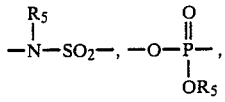

wherein $R_5$ represents a substituted or unsubstituted alkyl group, and

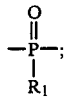

and l represents 0 or an integer of from 1 to 3; when l is 2 or 3, groups represented by $R_3$ may be the same or different.

2. A heat developable light-sensitive material as in claim 1, wherein $R_1$ is a hydrogen atom, an alkyl group having from 1 to 11 carbon atoms, a substituted or unsubstituted aryl group having from 6 to 10 carbon atoms, a cycloalkyl group having from 5 to 8 carbon atoms, an aralkyl group having from 7 to 12 carbon atoms, a styryl group, a phenylethynyl group, a 2-thienyl group, a 2-furyl group,

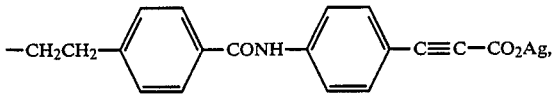

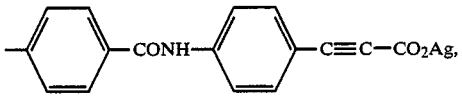

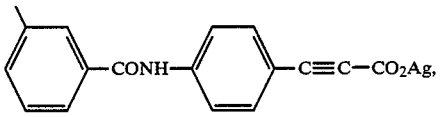

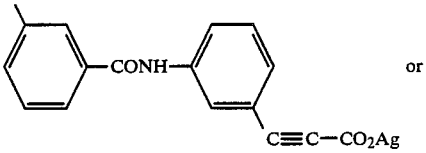

or

-continued

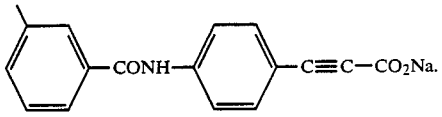

3. A heat developable light-sensitive material as in claim 1, wherein $R_2$ is a hydrogen atom.

4. A heat developable light-sensitive material as in claim 1, wherein $R_3$ is a methyl group, a methoxy group, a methoxyethoxy group, a halogen atom, an acylamino group having from 1 to 8 carbon atoms, an alkylsulfonylamino group having from 1 to 8 carbon atoms or an arylsulfonylamino group having 6 or 7 carbon atoms.

5. A heat developable light-sensitive material as in claim 1, wherein X is

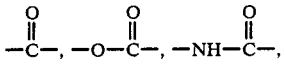

$-SO_2-$ or $-NHSO_2-$.

6. A heat developable light-sensitive material as in claim 1, wherein the organic silver salt is present in an amount of from 10 mg/m$^2$ to 10 g/m$^2$ or of from 0.01 to 200 mols per mol of the light-sensitive silver halide.

7. A heat developable light-sensitive material as in claim 1, wherein said organic silver salt has a mean grain size of 10 $\mu$m or less.

8. A heat developable light-sensitive material as in claim 1, wherein the coated silver coverage is from 1 mg to 10 g per m$^2$.

9. A heat developable light-sensitive material as in claim 1, wherein said reducing agent is employed in an amount of from 0.01 to 20 mols per mol of silver.

10. A heat developable light-sensitive material as in claim 9, wherein said reducing agent is employed in an amount of from 0.1 to 10 mols per mol of silver.

11. A heat developable light-sensitive material as in claim 1, wherein said binder is employed in an amount of from 5 to 90% based on the total weight of the coating.

12. A heat developable light-sensitive material as in claim 11, wherein said binder is employed in an amount of from 5 to 50% based on the total weight of the coating.

13. A heat developable light-sensitive material as in claim 1, wherein said amino group is an acylamino group, a sulfonylamino group, an alkylamino group or a dialkylamino group.

* * * * *